United States Patent [19]

Vergnani et al.

[11] 4,175,417

[45] Nov. 27, 1979

[54] WORKPIECE FORMING MACHINE

[76] Inventors: Leo H. Vergnani, 7 Spencer St.; John B. Ferrero, 916 Suffield St., both of Agawam, Mass. 01001; Ernest M. Cassanelli, 93 Grochmal Ave., Springfield, Mass. 01051

[21] Appl. No.: 856,409

[22] Filed: Dec. 1, 1977

[51] Int. Cl.[2] ..... B21D 22/00

[52] U.S. Cl. ..... 72/356; 10/76 T; 10/77; 10/78

[58] Field of Search ..... 72/356; 10/72 T, 76 T, 10/77, 78

[56] References Cited

U.S. PATENT DOCUMENTS

| | | | |
|---|---|---|---|
| 1,970,430 | 8/1934 | Nussbaum | 10/78 X |
| 1,993,137 | 3/1935 | Gibney | 10/78 X |
| 2,015,595 | 9/1935 | Frazer | 10/72 T |
| 2,149,578 | 3/1939 | Carney | 10/78 |
| 2,657,403 | 11/1955 | Eade et al. | 10/77 |

*Primary Examiner*—Leon Gilden

*Attorney, Agent, or Firm*—Ross, Ross & Flavin

[57] ABSTRACT

A high compression forming machine for forming workpieces such as nuts or like objects includes a toggle action subassembly for operating a Geneva-driven opposed-rams-press and cooperant vertically-disposed multiposition bolster or turret rotatably mounted relative to a frame about a horizontally-extending central axis and having a plurality of spaced, arcuately-arranged horizontally-extending work-receiving cavities extended therethrough, the center of each cavity being located with equal circular pitch along the circumference of a circle and allocated in order of successive operations in the work-forming process. It sequentially deforms workpieces through a simultaneous application thereto of opposing mechanical forces at opposite ends of the workpieces in a step-by-step manner as the bolster is sequentially rotated through a series of stations. The center of each cavity is located with equal circular pitch along the circumference of a circle and about a drive shaft adapted to transmit the intermittent rotary motion giving the step-by-step operation, the cavities being allocated in order of successive operations in the work-forming sequence.

1 Claim, 10 Drawing Figures

WORKPIECE FORMING MACHINE

The invention relates to the metal forming art and more particularly to an improved high compression forming machine.

The basic concept envisions a pair of forming members, supported relative to a frame, which are moved relatively toward and away from each other, the forming members mounting tool plates carrying pairs of die parts in manner such that the die parts are movable into and away from work forming relation with a bolster disposed therebetween and provided with work holding die cavities into the opposite ends of which the pairs of die parts are receivable as the forming members and tool plates move toward each other, same being impelled by a highly compressed working fluid within a cylinder or cylinders to drive the opposed die parts of each die set into work-forming relation so that each work part is successively subjected to a series of high energy impacts which cause the part to undergo plastic flow into conforming relation with each respective die cavity and the forming faces of the opposed die parts.

A tool plate carried by a forming member is disposed on each side of the bolster and each mounts a plurality of tools or dies of appropriate geometry extendable therefrom toward the bolster in planes parallel to the turret central axis, the tools of each tool plate being arcuately-arranged complementary to the arcuate arrangement of the work-receiving cavities in the bolster.

Each tool or die of one tool plate is matched with an opposing tool or die of the other tool plate in a tool couple relationship, the tools of each couple being unisonly driven toward each other and into the ends of an aligned work-receiving cavity of the bolster on each of the compressing strokes of the forming members and away from each other and out of the ends of the aligned cavity on each of the non-compressing strokes, such compressing and non-compressing strokes being allowed by coacting transversely-spaced toggle means provided for horizontally reciprocating the forming members and tool plates unisonly toward and away from the bolster in the respective work-forming and work-non-forming directions.

Indexing means cyclically index the bolster in sequential angular steps about the bolster axis, the tools of each tool couple being in coaxial alignment with one of the work-receiving cavities in each indexed bolster position. That is, the indexing subassembly serves to index the bolster about its horizontal axis so that a plurality of tool couples may be sequentially brought into confrontation with a particular work piece disposed in a particular cavity of the bolster to the end that a large number of parts can be formed to exactly the same dimensions without machine shutdown for tool replacement purposes.

Stated in another way, a rotatable indexable spindle directly connected to a Geneva driven indexing mechanism rotates the bolster so as to successively locate a work piece in operative position in horizontal alignment with the die parts of a sequential series of tool couples and is cooperant with a means for moving forming members and associated tool plates axially in work-forming directions. As the indexing mechanism spindle is rotated, the bolster is intermittently rotated and the forming members are moved axially toward and away from the bolster at each precise position, all responsively to the Geneva-driven spindle and the cam means thereon.

The tools of each tool couple are cooperant for reaction against the work at each end thereof, the work being nested within a respective bolster cavity. The generated forces of the toggle means in driving the tool plates toward each other in work-forming directions are sufficient for effecting a specific deforming step by each tool couple in the deforming sequence.

Stated in another way, the invention relates to a forming machine, and more particularly to the employment therewith of a pneumatic or hydraulic motor by which a pair of tool plates are moved on opposite sides of a bolster, toward and away from the bolster, whereby to apply to the work carried by the bolster even forming pressures at opposite ends of the work irrespective of the distribution of the load.

As one feature of the invention, we associate, with a pneumatic or hydraulic motor, a pair of opposed complementary toggle mechanisms adapted to be operated simultaneously and in unison upon release of a fluid force derived from a suitable source such as a pump. More particularly, we have so arranged and organized the operating parts that the force delivered by the motor is directed substantially in the line of movement of the interconnections between the several pairs of links which constitute the two opposed toggle mechanisms, all so as to utilize most effectively the mechanical force delivered by the motor. In addition, the two sets of toggle mechanisms are mechanically interconnected in such manner as to control their joint movements whereby movements of the tool plates proceed evently, irrespective of whether or not the load accommodated be evenly distributed.

Additionally, means may be provided for initially cutting the workpieces or blanks from a continuous supply of stock and for feeding each workpiece or blank to an empty bolster cavity preliminary to rotating the bolster to a first operational position where that workpiece or blank is acted upon by the die parts of the pair thereof. That rotation and all subsequent sequential rotational movements are effected by the multi-station Geneva drive subassembly.

The work in its cavity is transferred in successive stages of operation along a curvilinear path as the bolster is rotated, while successive work performing tool couples are simultaneously driven linearly toward and away from the work in each successive working position of the work, the freely rotatable turret being selectively locked relative to the machine by the locking capability of the indexing mechanism at each working position of the bolster.

Proper forming machine operation is allowed as the forming members are impelled toward one another with equal kinetic energies and simultaneous release of the forming members for movement in unison through their working or forming strokes under the force of the compression of the working fluid of a hydraulic cylinder or cylinders.

BRIEF DESCRIPTION OF THE DRAWINGS

The function and features, together with the principle of the motion of the feeding device for a former according to the present invention, will be described in detail with accompanying illustrations as follows.

DETAILED DESCRIPTION OF THE PREFERRED EMBODIMENTS

Figure 1:
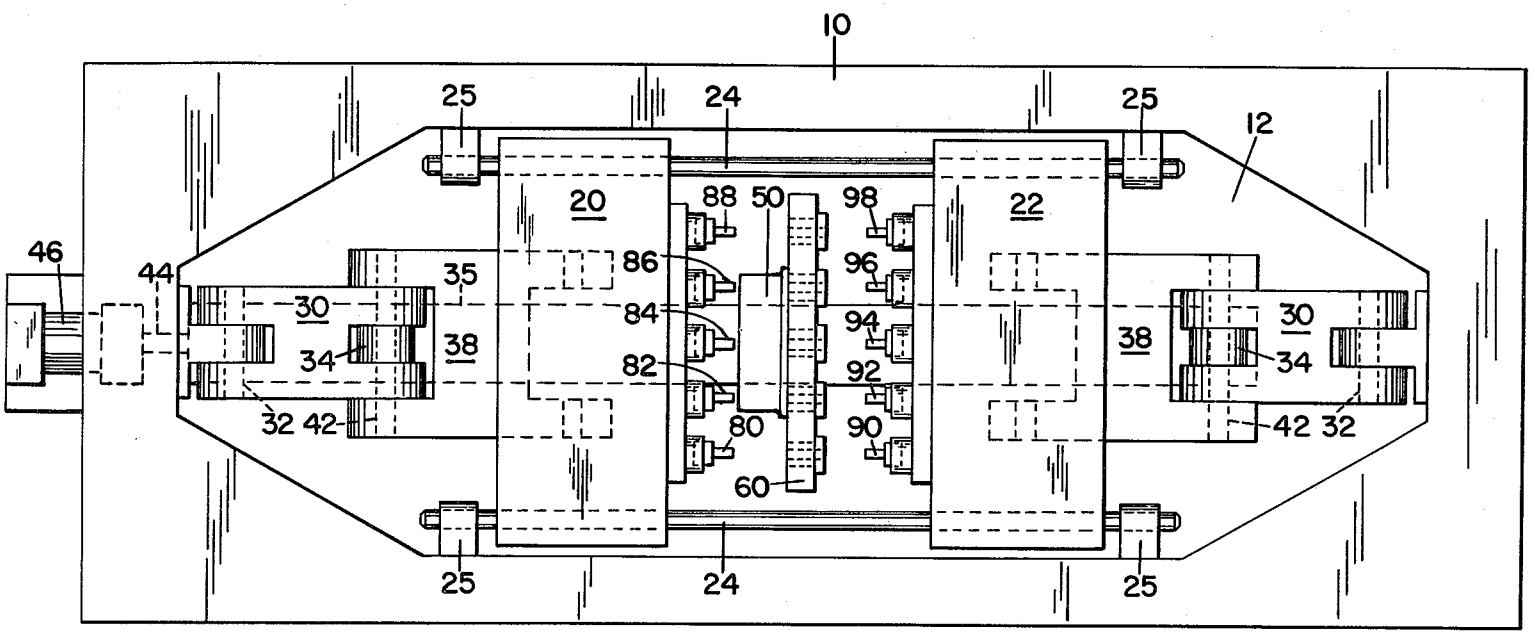
FIG. 1 illustrates, in top plan view, the forming apparatus and showing an arrangement of five working stations for purposes of exemplification only.
Figure 2:
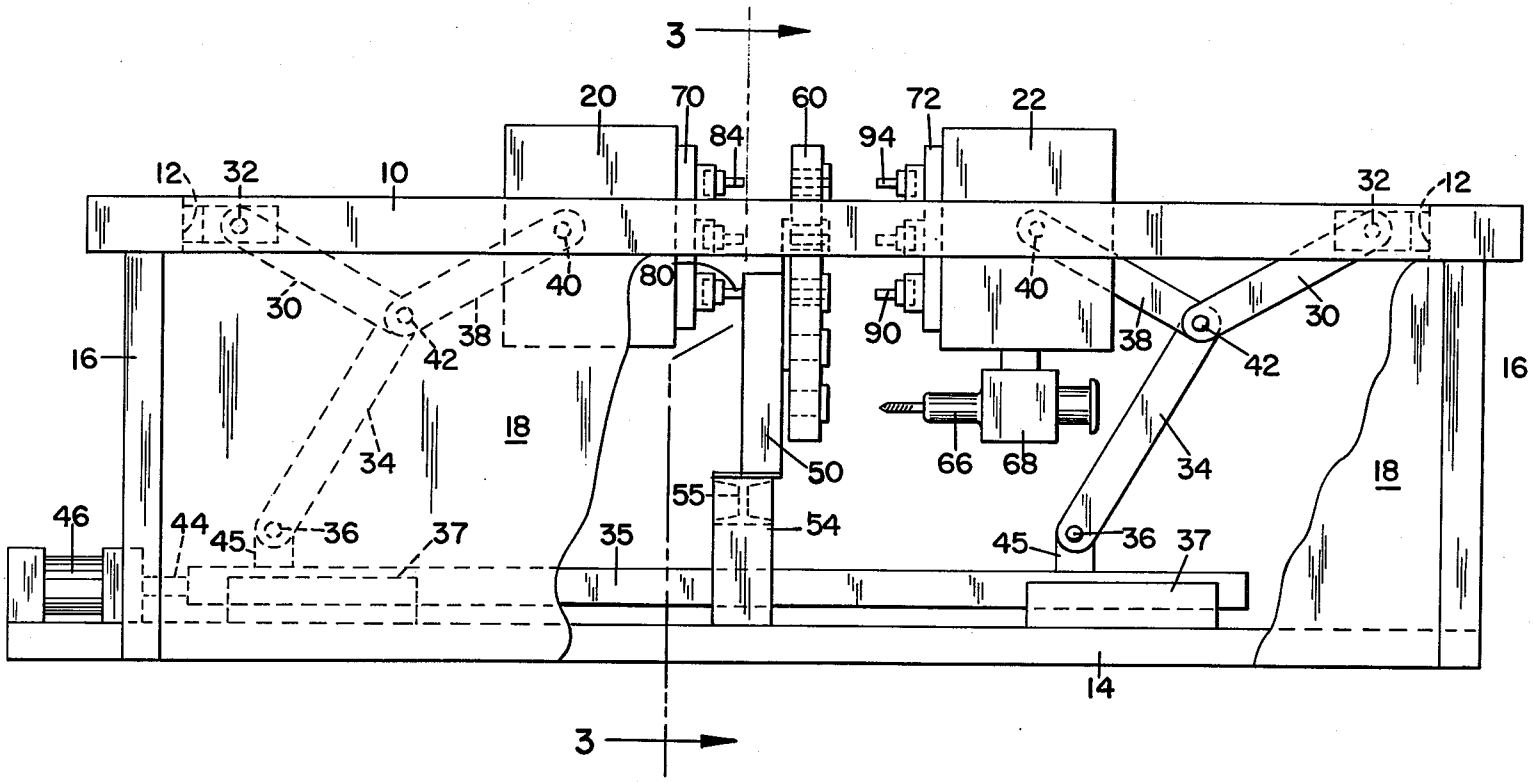
FIG. 2 illustrates, in side elevational view, the FIG. 1 apparatus.
Figure 3:
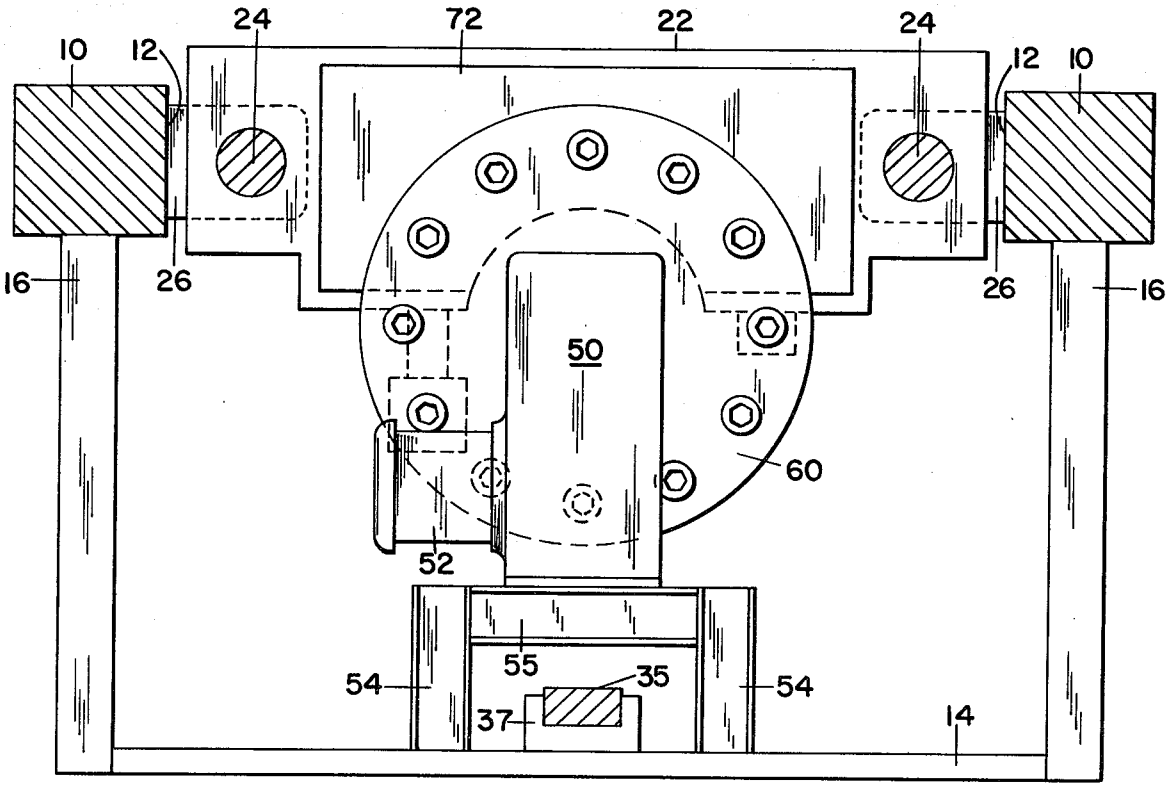
FIG. 3 illustrates, in side elevational view, the FIG. 1 apparatus, on a different scale, and showing the Geneva drive and bolster and is taken generally on the line 3—3 of FIG. 2.
Figure 6:
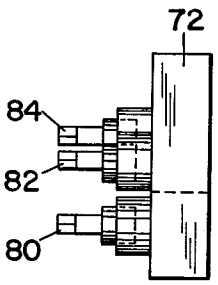
FIG. 6 is an end elevational view of the right hand (outboard) tool plate showing certain of the dies supported thereby.
Figure 7:
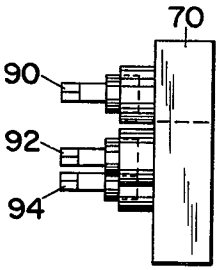
FIG. 7 is an inverted end elevational view of the left hand (inboard) tool plate showing certain of the dies supported thereby.

As shown in FIGS. 1–3, a horizontally-disposed table 10 having a central opening 12 therethrough is held upwardly of a base 14 by the usual vertical corner posts 16. Side and end plates 18 associated with the table, base and corner posts may enclose certain of the working parts below the table plane in conventional manner.

Freely extendable through central opening 12 at each opposite end of the table is one of a pair of axially-movable vertically-disposed forming ram assemblies, an inboard ram 20 and an outboard ram 22, each being supported by a pair of horizontally-extending ram rails 24 suitably supported as by spaced ram rail supports 25 on opposite machine sides. The rams are impelled along the ram rails in manner to ensure their precise coaxial alignment in all operational positions.

Inboard and outboard toggle arm assemblies are each constituted by an upper toggle link 30 having a pivotal interconnection with table 10 by a pivot 32, a lower toggle link 34 having a pivotal interconnection with a horizontally-extending shuttle bar 35 by a pivot 36, and a ram link having a pivotal interconnection with a respective ram by a pivot 40. The opposite ends of the links of each respective trio thereof are pivotally interconnected by a common pivot 42.

Shuttle bar 35 is centrally disposed relative to and supported upwardly of base 12 as by guide blocks 37 and is reciprocable in inboard-outboard directions by virtue of its driving connection to a piston rod 44 of a shuttle bar hydraulic or pneumatic cylinder 46. An hydraulic or pneumatic system (not shown) is provided for feeding the compressible working fluid under pressure to and venting the fluid from the cylinder in the driving of the shuttle bar.

The hydraulic or pneumatic motor comprises the cylinder 46 to which heads are fitted at opposite ends. One head is provided with an axial opening surrounded by a stuffing box through which is extended piston rod 44 having direct connection with a piston slidingly fitted within the cylinder as is known. Air under pressure (or other fluid force) is admitted to the cylinder at a point behind the piston, a tube extending therefrom to a source of fluid supply. The piston is caused to advance from one end of the cylinder to the other, its return movement taking place when air or fluid is admitted through another tube to the opposite cylinder end. Valve operation will open a passage for discharge of the air or fluid at the piston side opposite that upon which pressure is directed.

By virtue of the pneumatic or hydraulic motor, the opposed complementary toggle mechanisms are adapted to be operated simultaneously and in unison upon release of the fluid force which is derived from any suitable source. The mechanical force delivered by the motor is directed substantially in the line of movement of the interconnections between the several pairs of links which constitute the two opposed toggle mechanisms, so as to utilize that mechanical force most effectively. In addition, the two sets of toggle mechanisms are mechanically interconnected in such a way as to control their joint movements whereby movement of the rams proceeds evenly, irrespective of whether or not the load accommodated thereon be evenly distributed.

The rams are movable conjointly by virtue of the common linkage through the toggles to shuttle bar 35 which is impelled by piston rod 44 of cylinder 46.

The rams are movable toward each other through working strokes into forming impact with work parts held in a vertically-disposed bolster 60 supported relative to the frame between the rams. Retraction of the rams in non-working, cocking, strokes compresses the cylinder working fluid to the desired high work forming pressure.

A vertically-disposed indexing mechanism subassembly 50 is driven by a motor 52, is supported upwardly of base 12 by a column 54, and rotatively supports bolster 60. Such subassembly is not shown in detail, it being of the intermitter type, as sourced by Ferguson Machine Company of St. Louis, Mo., drive code 12-5202M-90, and typical of mechanisms such as used for indexing dials and turrets and other applications having high inertias or where torsional vibrations are serious. Such a unit envisions 12 stops of the indexing shaft per each cam revolution and an index period of 90° of rotation of the cam. Auxiliary equipment such as the power supply and control panel and other accessories, all readily available, are likewise not shown, same constituting part of the indexing system and conventionally available with such when the system is procured.

Preferentially, the power supply is integrally mounted on the index drive with an associated anti-backlash worm and gear reducer for offering full capacity in dwell time regulation and an economical power transmission system to accommodate to the inherent torque requirements. The indexing mechanism offers a continuous motion output shaft or spindle along which various cams may be splined for effecting other related movements, as may be desired such as for example, the operation of a conventional wire or rod cut off assembly (not shown) which may be disposed adjacent the tool plate for cutting off blanks or slugs from a wire or rod supply.

Likewise, a tapping head assembly 66 may be attached to a support 68 depending downwardly of and from ram 22.

Figure 4:
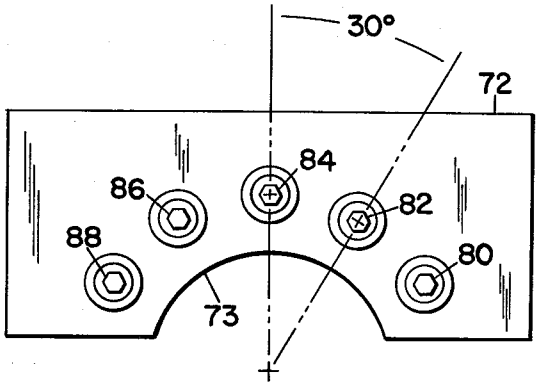
FIG. 4 illustrates, in side elevational view, the right hand tool plate.
Figure 5:
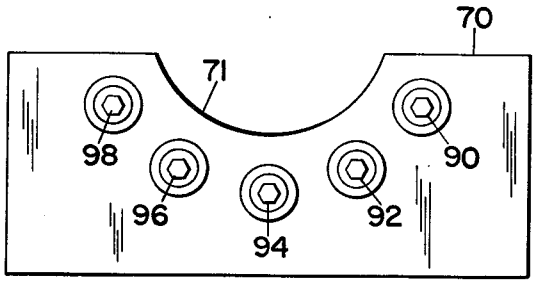
FIG. 5 illustrates, in inverted side elevational view, the left hand tool plate.
Figure 8:
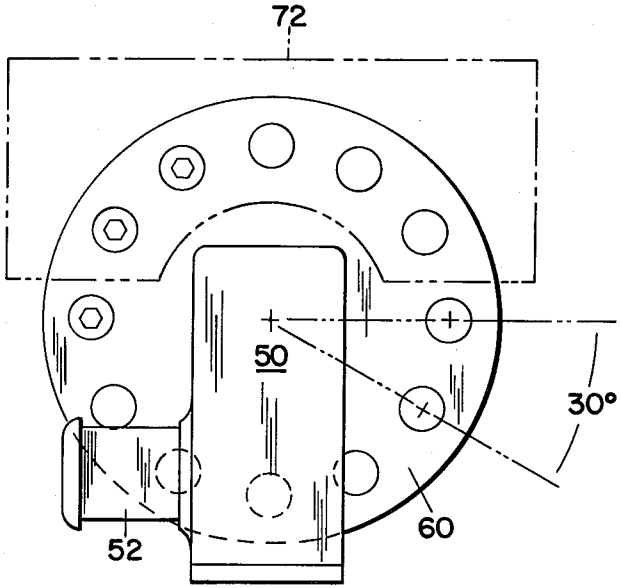
FIG. 8 is a fragmentary side elevational view of the bolster and Geneva.

A tool plate is mounted on each of the confronting faces of the rams, the inboard ram mounting an inboard tool plate 70 (FIG. 5) and the outboard ram mounting an outboard tool plate 72 (FIG. 4), the inboard tool plate 70 in FIG. 5 being shown in inverted view relative to the outboard tool plate 72 in FIG. 4.

The tool plates are preferentially provided with cut out portions 71 and 73 respectively to provide for clearance around the indexing subassembly.

Tool plates 70 and 72 each mount a series of equi-spaced tools such as die parts 80, 82, 84, 86 and 88 conventionally mounted as shown on inboard tool plate 70 and a series of equi-spaced tools such as die parts 90, 92, 94, 96 and 98 conventionally mounted as shown on outboard tool plate 72.

Die parts 80, 82, 84, 86 and 88 form tool couples with die parts 90, 92, 94, 96 and 98 respectively.

The impact loads exerted on the bolster or turret are equalized so as to virtually eliminate any unbalanced impart loading of the bolster, the cavities being of such design as to hold the work parts to be formed in fixed positions between the forming rams. The work pieces or slugs remain in their respective cavities following insertion, through all work stations, until final ejection following the work sequence.

The forming rams are movable between the retracted cocked positions and extended work-forming positions wherein the cooperating die parts on the die plates are projected into the cavities of the bolster.

A clamping pressure is applied between the rams and base to urge the plates toward the bolster, the pressure being made sufficient to urge the confronting faces of the dies into firm contact with the work so as to prevent the formation of "flash" on the work parts during forming.

Movement of the rams between cocked and extended positions is referred to as the working stroke, the rams being impelled at steady velocity by the force of the compressed working fluid in the ram pressure cylinder.

Retraction of the forming rams to cocked position compresses the working fluid to the proper pressure for impelling the rams through their working strokes.

The ram masses and pressures are such that the rams produce substantially equal but opposite impact loads on the bolster during each forming operation of the machine.

Accordingly, the bolster and frame are not subjected to any appreciable unbalanced impact loads.

Assuming that the forming rams are initially fully extended by the fluid pressure in the cylinder, the cylinder is then pressurized to expand the forming rams to their cocked positions, with the work parts being clamped in forming positions in the bolster so that each extends within its respective cavity with space at either end for the protrusion of the forming dies thereinto.

The forming ram assemblies are adjustable relative to the frame to accommodate to work parts of varying length. More specifically, the ram assemblies are adjusted to positions such that the spacing between the outer ends of the forming rams when in their retracted cocked positions and the bolster is equal to the full length of the ram working strokes. Accordingly, the rams undergo their full working strokes for every size work part. The ram assemblies are thus adjustable along the base.

Figure 9:
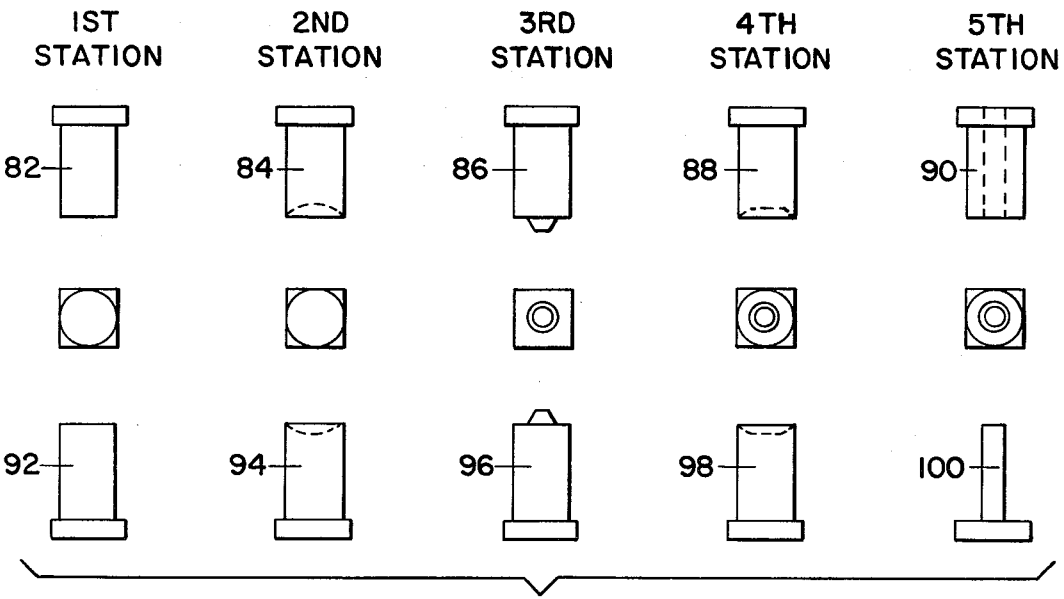
FIG. 9 shows a series of outboard dies and complementary inboard dies comprising five die sets as well as an end view of the workpiece as developed at each of the respective work stations.

There is shown in FIG. 9, a series of outboard (top row) and related inboard (bottom row) work forming dies designated stations 1 through 5 and therebetween in the middle row is shown the outboard face of the workpiece formed upon completion of the work forming stroke at that respective station, Station 1 showing the effect of blocking off the sides of the cavity as the two dies are brought toward each other, Station 2 showing the effect of using rounded concaved dimpling on each of the dies to cause a further foreshortening of the piece and the further expansion thereof toward the cavity wall, Station 3 showing the effect of chamferring the dome on each side of the workpiece, Station 4 showing the effect of crowning the opposite faces of the workpiece, and Station 5 showing the effect of backing up one side of the work piece while piercing a hole therethrough with a piercing die.

Figure 10:
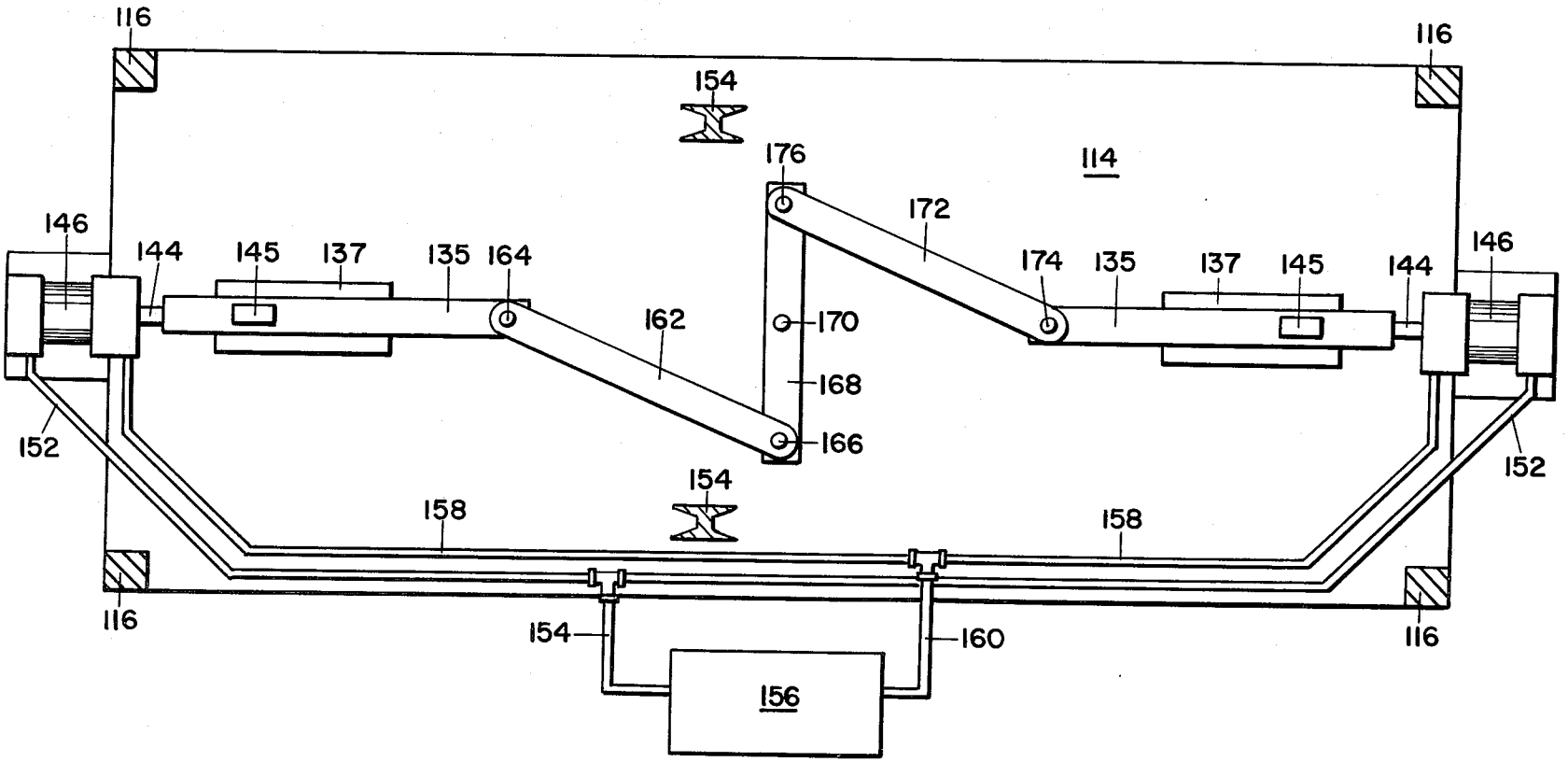
FIG. 10 is a view in top plan of the base and showing an alternative arrangement incorporating a pair of opposied hydraulic cylinders and a pair of opposed shuttle bars, each shuttle bar and cooperant cylinder serving to operate but one of the rams through its respective toggle arm assembly.

Further by way of exemplification, an alternate arrangement incorporating a pair of opposed hydraulic cylinders mechanically interlocked as by a bell crank in lieu of a single hydraulic cylinder is shown in FIG. 10.

Therein, in plan view, is shown, relative to a base 114 with its usual corner posts 116, a pair of longitudinally aligned shuttle bars 135 spaced from each other and movable unisonly in opposite directions centrally of the base (toward each other in their respective compression strokes; away from each other in their respective retraction strokes).

Shuttle bars 135 are each supported upwardly of base 114 by a suitably-positioned guide block 137. They are reciprocable in their inboard-outboard directions by virtue of their driving connections to respective pistons 144 of respective shuttle bar hydraulic cylinders 146 at opposite ends of the machine.

A hydraulic system for feeding a compressible working fluid under pressure to one side of a respective cylinder is represented by a respective branch feed line 152, which branch feed line connects to a common feed line 154 and thence to a pump 156 and for returning the working fluid from the other side of a respective cylinder is represented by a respective branch feed line 158 which branch feed line connects to a common feed line 160 and thence to pump 156.

The rams, through the respective toggle linkages previously described, are movable conjointly by virtue of a bell crank linkage interconnecting the shuttle bars and comprising a inboard shuttle bar link 162 pivotally connected at 164 to the free end of its served shuttle bar 135 and at 166 to one end of a common base link 168 which is pivoted at 170 to base 114, with the outboard shuttle bar link 172 pivotally connected at 174 to the free end of its served shuttle bar 135 and at 176 to the other end of common base link 168.

I claim:

1. In apparatus for sequentially cold forming a work by changing the configuration thereof through a step-by-step application thereto of opposing mechanical forces, the improvement comprising:

a frame, a drive motor, a multiposition turret rotatably mounted in vertical disposition centrally of the frame and about a horizontally-extending central axis and having a plurality of spaced circularly-arranged work cavities extending horizontally therethrough from one vertical face to the opposite vertical face, a die receivable in each work cavity, a cam-operated multistation indexing mechanism driven by the drive motor and rotatively supporting the turret for intermittently rotating and cyclically indexing the turret at stations through a series of sequential angular steps, a ram vertically-disposed relative to the frame on each side of the turret, a pair of horizontally-extending ram rails mounted on the frame for supporting the rams coaxially in slidable relationship alternately toward each other in forming strokes and away from each other in non-forming strokes, a shuttle bar cylinder and piston, power means for cyclically actuating the piston in alternating forming and non-forming strokes, a horizontally-extending shuttle bar disposed centrally of the frame and connected to and driven by the piston and reciprocable linearly in forming and non-forming strokes, a moving assembly at each end of the frame outboard of a respective ram and including a trio of pivotally interconnected power links consisting of an upper power link pivotally interconnected with the frame and a lower power link pivotally interconnected with the shuttle bar and a forward link pivotally interconnected with the respective ram for effecting simultaneous movements of the rams toward each other in forming strokes and away from each other in non-forming strokes, a tool plate mounted on each ram for supporting a plurality of circularly arranged tools extendable therefrom in planes normal thereto toward the respective confronting vertical turret face, each tool of the tool plate being disposed in a plane coaxial with the opposed tool of the other tool plate in a tool-couple relationship and with the axis of one of the turret work cavities, with turret rotation transferring a work to successive stations of operation along a curvilinear path preparatory to the simultaneous linear reciprocation of a pair of the tools toward the work at the station.

* * * * *